US006177827B1

(12) United States Patent
Ota

(10) Patent No.: US 6,177,827 B1
(45) Date of Patent: Jan. 23, 2001

(54) CURRENT MIRROR CIRCUIT AND CHARGE PUMP CIRCUIT

(75) Inventor: Yoshiyuki Ota, Tokyo (JP)

(73) Assignee: Mitsubishi Denki Kabushiki Kaisha, Tokyo (JP)

( * ) Notice: Under 35 U.S.C. 154(b), the term of this patent shall be extended for 0 days.

(21) Appl. No.: 09/184,649

(22) Filed: Nov. 3, 1998

(51) Int. Cl.[7] ..... G05F 1/10
(52) U.S. Cl. ..... 327/536; 327/53; 327/60
(58) Field of Search ..... 327/536, 534, 327/535, 537, 530, 53, 60, 538; 323/315; 326/88

(56) References Cited

U.S. PATENT DOCUMENTS

| | | | | |
|---|---|---|---|---|
| 5,300,837 | * | 4/1994 | Fischer | 327/281 |
| 5,483,151 | * | 1/1996 | Yamashita | 323/312 |
| 5,694,076 | * | 12/1997 | Ishibashi | 327/538 |
| 5,703,497 | * | 12/1997 | Min | 326/33 |
| 5,708,420 | * | 1/1998 | Drouot | 340/660 |
| 5,812,029 | * | 9/1998 | Prentice | 330/278 |
| 6,040,742 | * | 3/2000 | Bailey et al. | 331/2 |

FOREIGN PATENT DOCUMENTS 4-192608 7/1992 (JP) .

* cited by examiner

*Primary Examiner*—Terry D. Cunningham
*Assistant Examiner*—Hai L. Nguyen
(74) *Attorney, Agent, or Firm*—Burns, Doane, Swecker & Mathis, LLP

(57) ABSTRACT

There is provided a current mirror circuit which suppresses variations in an output current resulting from the Early effect. A pair of transistors (T1, T2) of a conventional current mirror circuit have gates connected to each other, and sources connected to each other, with the gate and drain of one of the transistors short-circuited. The source and drain of the other transistor (T2) on an output current side are connected to the source and gate of a transistor (T3), respectively. The sources of all of the transistors (T1, T2, T3) are commonly connected to a constant current circuit comprised of a bias voltage generating circuit (VB1) and a transistor (T4). A bias point is determined so that the increase/decrease in a current (Iout) causes the increase/decrease in a current (Icom), and the sizes of the respective transistors are designed.

11 Claims, 5 Drawing Sheets

CURRENT MIRROR CIRCUIT AND CHARGE PUMP CIRCUIT

BACKGROUND OF THE INVENTION

1. Field of the Invention

The present invention relates to a current mirror circuit for generating a current which is in a constant ratio to a reference current.

2. Description of the Background Art

In general, semiconductor integrated circuits often employ a current mirror circuit for generation of a current which is in a constant ratio to a reference current (including a current equivalent to the reference current). FIG. 6 is a circuit diagram illustrating the construction of a current mirror circuit CM2. The current mirror circuit CM2 comprises two N-channel MOS transistors T1 and T2 having sources connected to each other and gates connected to each other, with the drain of the N-channel MOS transistor T1 connected to the gate thereof.

In the current mirror circuit CM2, since the N-channel MOS transistors T1 and T2 are at the same gate potential, a reference current Iref supplied to the drain of the N-channel MOS transistor T1 provides a constant ratio of the value of the reference current Iref to the value of a current Iout flowing between the drain and source of the N-channel MOS transistor T2. This ratio may be controlled depending on a size ratio between the N-channel MOS transistors T1 and T2.

The current mirror circuit CM2, of course, may employ P-channel MOS transistors. Also, bipolar transistors may be used in place of the MOS transistors, in which case the sources, drains and gates of the above described MOS transistors should be replaced with emitters, collectors and bases, respectively, for connections therebetween. In such cases, similar size adjustment may be made to generate the current Iout which is in a constant ratio to the reference current Iref.

Such a current mirror circuit is based on the precondition that it operates in a so-called constant current region (referred to as a saturated region for a MOS transistor or as an unsaturated region for a bipolar transistor) which is found in the relationship between a drain-source voltage and a drain-source current for a MOS transistor or the relationship between a collector-emitter voltage and a collector-emitter current for a bipolar transistor.

Unfortunately, the bipolar transistor presents the problem of the Early effect such that the increase in a base-collector voltage changes the width of a depletion layer between the base and the collector to change a substantial base layer width. As the collector-emitter voltage increases, the collector-emitter current is not constant but slightly increases because of the Early effect. Thus, the change in the collector-emitter voltage causes the change in the collector-emitter current even in the so-called constant current region, although a base-emitter current is constant.

Similarly, also in the MOS transistor, as the drain-source voltage increases, the drain-source current is not constant but slightly increases even if a gate-source voltage is constant. This results from the change in a channel length and is described using a value known as a channel length modulation parameter.

For this reason, for example, in the above described current mirror circuit CM2, when the drain-source voltage of the N-channel MOS transistor T2 varies, the value of the output current Iout is changed. This might fail to provide the constant ratio between the value of the reference current Iref and the value of the output current Iout which should be determined only by the transistor size ratio.

SUMMARY OF THE INVENTION

According to a first aspect of the present invention, a current mirror circuit comprises: an output terminal; a first transistor having a first current electrode, a second current electrode, and a control electrode connected to the first current electrode, there being a flow of a reference current between the first and second current electrodes; a second transistor having a first current electrode connected to the output terminal, a second current electrode connected to the second current electrode of the first transistor, and a control electrode connected to the control electrode of the first transistor; a third transistor having a first current electrode, a second current electrode connected to the second current electrode of the first transistor, and a control electrode connected to the output terminal, there being a flow of a predetermined current between the first and second current electrodes of the third transistor; and a first constant current source connected to the second current electrode of the first transistor.

According to a second aspect of the present invention, a charge pump circuit comprises: an output terminal; a first transistor having a first current electrode, a second current electrode, and a control electrode connected to the first current electrode, there being a flow of a reference current between the first and second current electrodes; a second transistor having a first current electrode connected to the output terminal, a second current electrode connected to the second current electrode of the first transistor, and a control electrode connected to the control electrode of the first transistor; a third transistor having a first current electrode, a second current electrode connected to the second current electrode of the first transistor, and a control electrode connected to the output terminal, there being a flow of a predetermined current between the first and second current electrodes of the third transistor; a first constant current source connected to the second current electrode of the first transistor; a fourth transistor having a first current electrode connected to the output terminal, a second current electrode, and a control electrode; a first operational amplifier having a first input connected to the second current electrode of the fourth transistor, a second input receiving a reference potential, and an output connected to the control electrode of the fourth transistor; and a first filter receiving a first pulse signal for smoothing the first pulse signal to apply the smoothed first pulse signal to the second current electrode of the fourth transistor.

Preferably, according to a third aspect of the present invention, the charge pump circuit of the second aspect further comprises: a fifth transistor having a first current electrode connected to the first current electrode of the first transistor, a second current electrode, and a control electrode; a second operational amplifier having a first input connected to the second current electrode of the fifth transistor, a second input receiving the reference potential, and an output connected to the control electrode of the fifth transistor; and a second filter receiving a second pulse signal for smoothing the second pulse signal to apply the smoothed second pulse signal to the second current electrode of the fifth transistor.

In the current mirror circuit of the first aspect of the present invention, when the potential at the output terminal varies, the third transistor flows the current which increases/ decreases depending on the variations in the potential at the output terminal, and the output current supplied from the second transistor to the output terminal is limited by the constant current. Therefore, the variations in the output current is suppressed.

In the charge pump circuit of the second aspect of the present invention, if the potential at the output terminal varies, the potential at the second current electrode of the fourth transistor is held stable by the negative feedback provided by the first operational amplifier. Thus, the fourth transistor can supply a substantially direct current having a value depending on the first pulse signal to the output terminal.

In the charge pump circuit of the third aspect of the present invention, the fifth transistor draws a substantially direct current having a value depending on the second pulse signal from the output terminal through the first and second transistors. Thus, a substantially direct current having a value depending on the difference between the first and second pulse signals is provided at the output terminal.

It is therefore an object of the present invention to provide a current mirror circuit of a construction which provides a smaller amount of change in an output current than does a conventional circuit construction when a drain-source voltage (in the case of a MOS transistor) or a collector-emitter voltage (in the case of a bipolar transistor) of an output current generating transistor changes.

The term "Early effect" used herein is meant to define both phenomena in which a collector-emitter current of a bipolar transistor in relation to a collector-emitter voltage is not constant but slightly increases in a so-called constant current region and in which a drain-source current of a MOS transistor in relation to a drain-source voltage is not constant but slightly increases in the constant current region.

These and other objects, features, aspects and advantages of the present invention will become more apparent from the following detailed description of the present invention when taken in conjunction with the accompanying drawings.

DESCRIPTION OF THE PREFERRED EMBODIMENTS

First Preferred Embodiment

Figure 1:
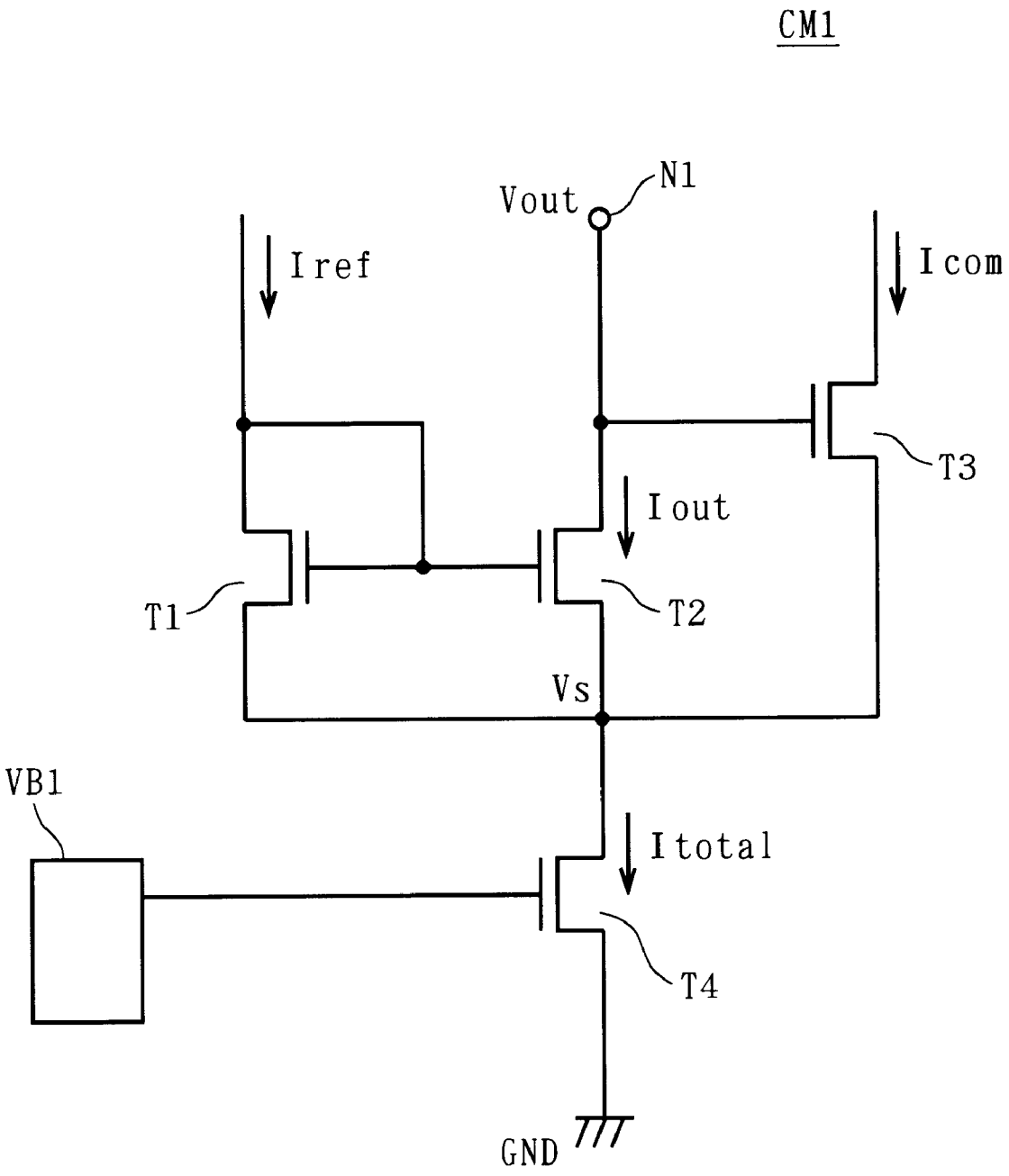
FIG. 1 is a circuit diagram showing the construction of a first preferred embodiment according to the present invention.

FIG. 1 is a circuit diagram showing the construction of a current mirror circuit CM1 according to a first preferred embodiment of the present invention. The current mirror circuit CM1, similar to the background art current mirror circuit CM2 shown in FIG. 6, comprises N-channel MOS transistors T1 and T2 having sources connected to each other and gates connected to each other, with the drain of the N-channel MOS transistor T1 connected to the gate thereof. The current mirror circuit CM1 is also similar to the background art current mirror circuit CM2 in that a reference current Iref is provided to the drain of the N-channel MOS transistor T1 and that an output current Iout flows between the source and drain of the N-channel MOS transistor T2. It is assumed herein that an output terminal N1 directly connected to the drain of the N-channel MOS transistor T2 is at a potential Vout relative to a ground potential GND.

The current mirror circuit CM1 further comprises an N-channel MOS transistor T3 having a gate connected to the drain of the N-channel MOS transistor T2 and a source connected to the source of the N-channel MOS transistor T2. It is assumed that the drain of the N-channel MOS transistor T3 is connected to a power supply not shown and that a current Icom flows between the drain and source of the N-channel MOS transistor T3.

The current mirror circuit CM1 further comprises an N-channel MOS transistor T4 having a source receiving the ground potential GND, and a drain connected commonly to the sources of the N-channel MOS transistors T1, T2 and T3. The sources of the N-channel MOS transistors T1, T2 and T3 are assumed to be at a potential Vs relative to the ground potential GND. An output from a bias voltage generating circuit VB1 is applied to the gate of the N-channel MOS transistor T4 so that a constant current Itotal flows between the drain and source of the N-channel MOS transistor T4. In other words, the bias voltage generating circuit VB1 and the N-channel MOS transistor T4 constitute a constant current circuit which controls the current Itotal that is the sum of the currents Iref, Iout and Icom flowing through the current mirror circuit CM1.

Figure 2:
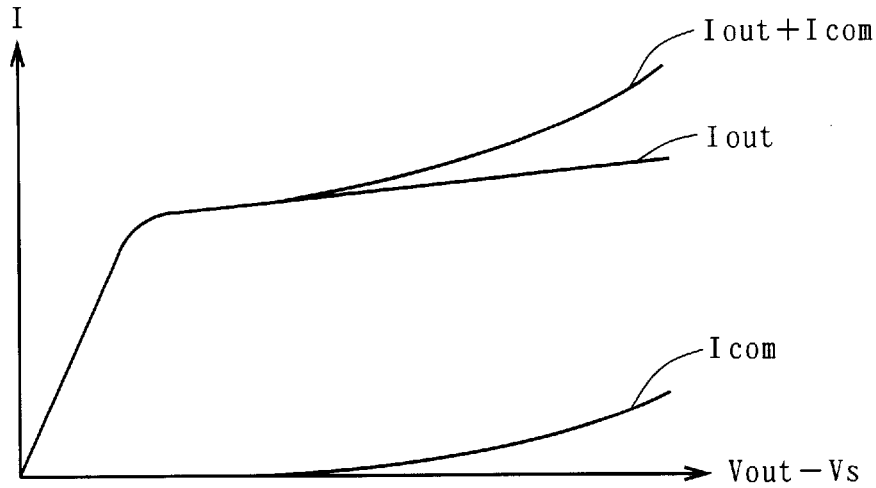
FIG. 2 is a graph showing current-voltage characteristics of the first preferred embodiment.

The principle that the current mirror circuit CM1 as constructed above compensates for the Early effect will be described below. FIG. 2 is a graph showing a plot of the current Iout flowing through the N-channel MOS transistor T2 and the current Icom flowing through the N-channel MOS transistor T3 against a voltage Vout−Vs serving as the drain-source voltage of the N-channel MOS transistor T2 and also as the gate-source voltage of the N-channel MOS transistor T3 on the assumption that the constant current circuit comprised of the bias voltage generating circuit VB1 and the N-channel MOS transistor T4 is not present and that the current Itotal that is the sum of the currents Iref, Iout and Icom is not limited. For example, when the source and drain of the N-channel MOS transistor T4 are short-circuited, Vs=0 is obtained and the above assumption is achieved.

As the voltage Vout−Vs increases, the current Iout in the constant current region of the N-channel MOS transistor T2 exhibits a monotonical increase approximately represented by a linear function because of the Early effect. The current Icom, on the other hand, exhibits a monotonical increase approximately represented by a quadratic function with the increase in the voltage Vout−Vs when a voltage which operates the N-channel MOS transistor T3 in the constant current region is applied between the source and drain thereof since the voltage Vout−Vs serves as the gate-source voltage of the N-channel MOS transistor T3. As a result, the sum of the current Iout and the current Icom exhibits a curve indicated by the current Iout+Icom of FIG. 2.

Figure 3:
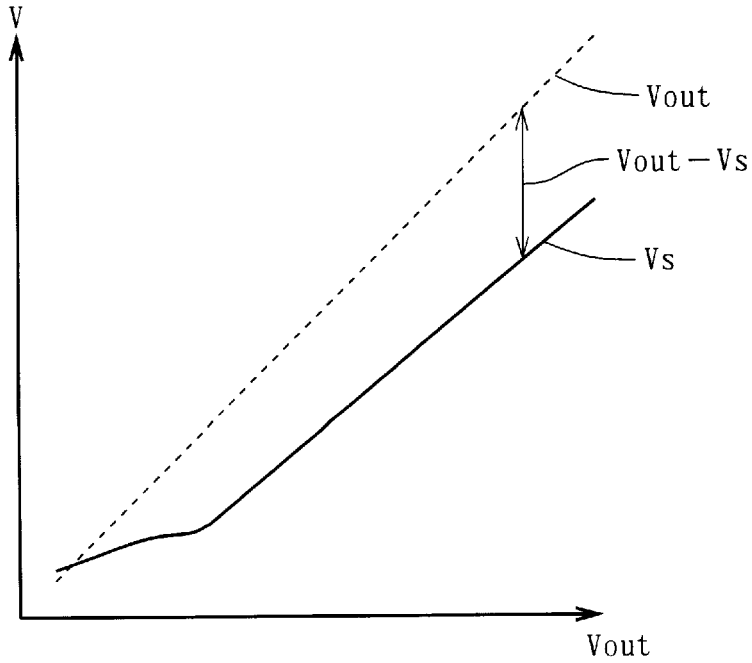
FIG. 3 is a graph showing the relationship between the voltages of respective portions of the first preferred embodiment.

FIG. 3 is a graph showing the result of simulation which determines the relationship between the potential Vs and the potential Vout in the circuit shown in FIG. 1. It is understood from the result that the potential Vs is in a generally linear relationship with the potential Vout. Therefore, the voltage Vout−Vs, the potential Vout, and the potential Vs are in a generally linear relationship with each other.

Figure 4:
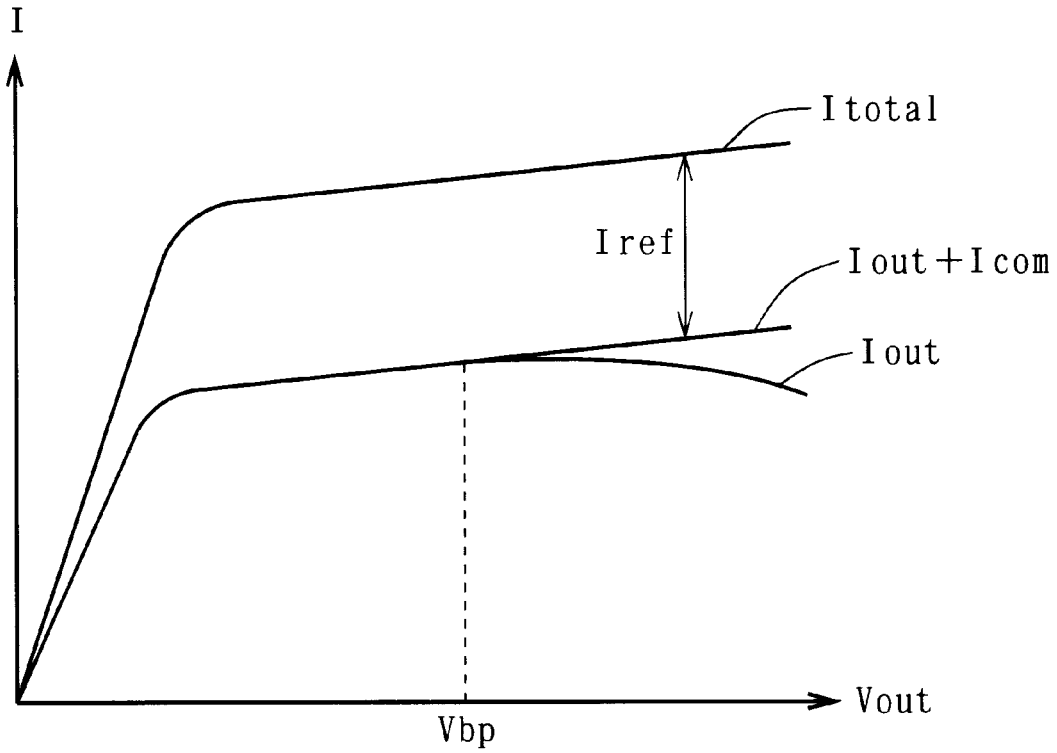
FIG. 4 is a graph showing current-voltage characteristics of the first preferred embodiment.

FIG. 4 is a graph showing a plot of the current Itotal flowing through the N-channel MOS transistor T4 and currents flowing through respective portions derived therefrom against the voltage Vout in the circuit shown in FIG. 1. The Early effect occurs also in the constant current region of the N-channel MOS transistor T4, and the potential Vout and the potential Vs are in a linear relationship with each other. Thus, the graph depicting the relationship between the current Itotal and the potential Vout exhibits a steep linear slope in a region where the potential Vout is low, and a gentle linear slope in a region where the potential Vout is high.

It is now assumed that the value of the reference current Iref is constant. Since the current Itotal is the sum of the currents Iref, Iout and Icom, the current Iout+Icom equals the current Itotal minus the constant value of the current Iref. Thus, the curve indicative of the current Iout+Icom plotted against the potential Vout which is additionally illustrated in FIG. 4 is provided by the substantial translation of the curve indicative of the current Itotal plotted against the potential Vout in the direction of decreasing current.

The current Iout+Icom, however, tends to increase more abruptly than the linear function against the voltage Vout−Vs as shown in FIG. 2 if the current Iout+Icom is not limited by the current Itotal. If the current Iout+Icom is limited by the current Itotal, the current Iout against the potential Vout exhibits a curve which opens downwards and has a maximum value when Vout=Vbp.

It is found that when the potential Vout which is close to the value Vbp varies, the value of the current Iout makes little change. The same may be true for the current Iout against the voltage Vout−Vs in consideration for the linear relationship between the potential Vout and the voltage Vout−Vs. Thus, when the drain-source voltage Vout−Vs of the N-channel MOS transistor T2 varies, the drain-source current Iout makes little change. It is understood from the above description that the value Vbp is not dependent upon the reference current Iref.

The current mirror circuit CM1 thus compensates for the Early effect in the N-channel MOS transistor T2. Therefore, the gate lengths and gate widths of the N-channel MOS transistors T1 to T4 may be adjusted so that the voltage value Vbp at which the current Iout makes an increase-to-decrease transition with the increase in the potential Vout is used as a bias point. This suppresses the variations in the current Iout resulting from the variations in the potential Vout independently of the reference current Iref.

The monotonical increase in the current Icom which is approximately represented by the quadratic function is not essential according to the present invention. Furthermore, it is not essential to operate the N-channel MOS transistor T3 in the constant current region since the current Icom is required only to partially constitute the current Itotal in conjunction with the current Iout.

Figure 6:
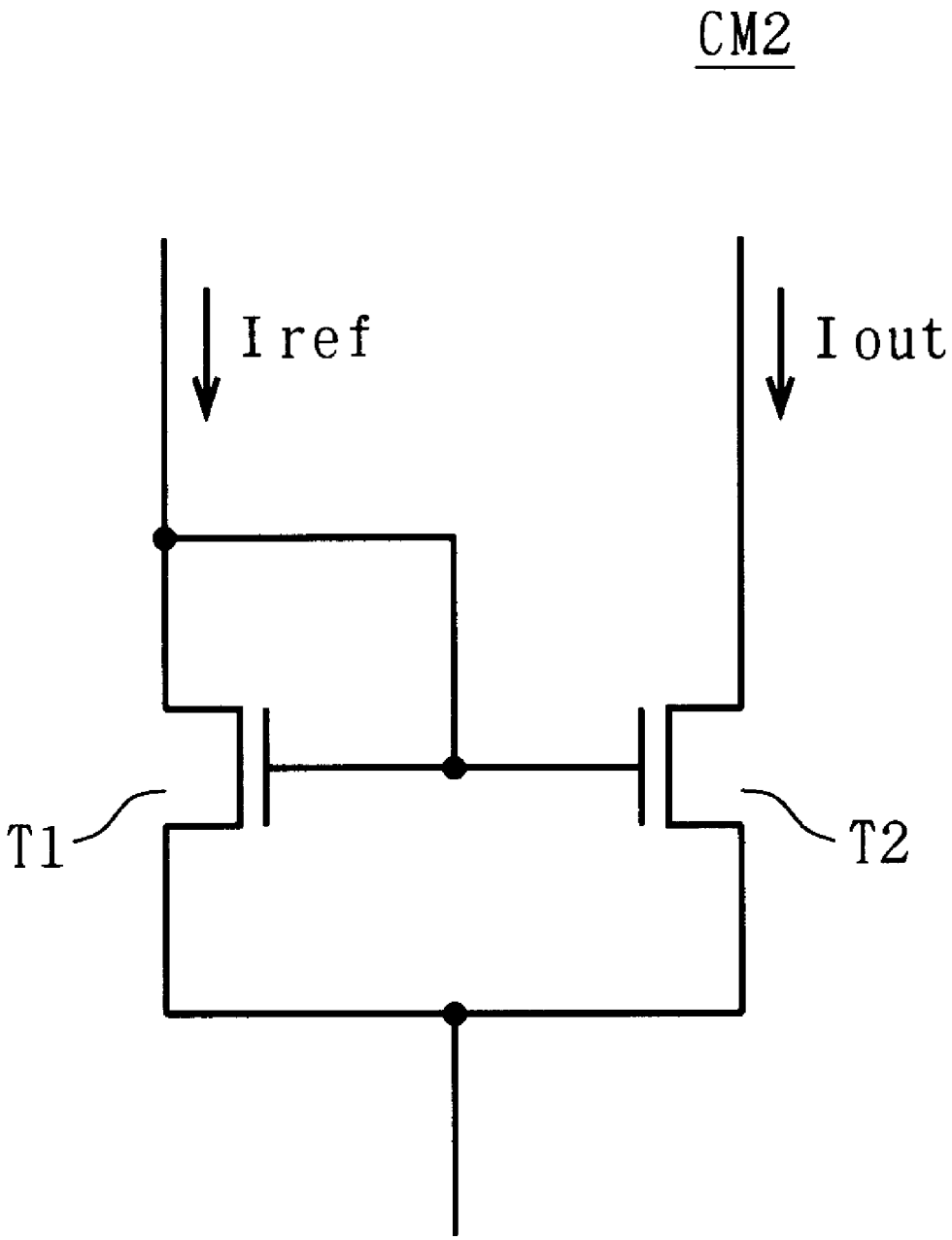
FIG. 6 is a circuit diagram of a background art circuit construction.

Although the MOS transistors are used in the first preferred embodiment for purposes of description as in FIG. 6, the current mirror circuit CM1, of course, may employ bipolar transistors, in which case the sources, drains, and gates of the above described MOS transistors should be replaced with emitters, collectors and bases, respectively.

Second Preferred Embodiment

Figure 5:
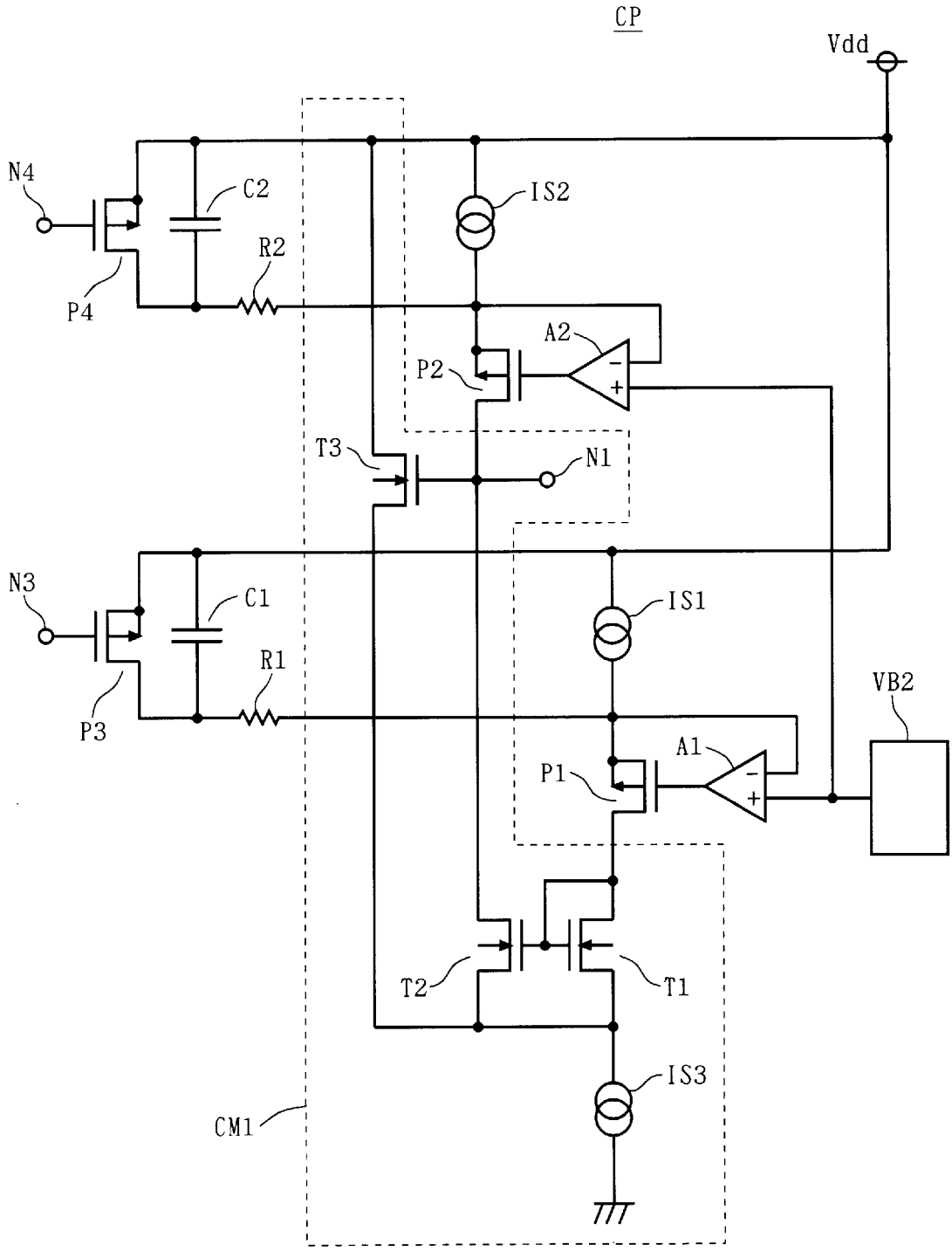
FIG. 5 is a circuit diagram showing the construction of a second preferred embodiment according to the present invention.

FIG. 5 shows a charge pump circuit CP for use in a PLL (Phase Locked Loop) circuit and the like to which the current mirror circuit CM1 disclosed in the first preferred embodiment is applied. The charge pump circuit CP comprises input terminals N3 and N4 and an output terminal N1 (also serving as an output terminal of the current mirror circuit CM1). The charge pump circuit CP has the functions of causing a current having a value proportional to the pulse width of a pulse voltage signal (referred to hereinafter as a DOWN signal) applied to the input terminal N3 to flow into the charge pump circuit CP at the output terminal N1, and of causing a current having a value proportional to the pulse width of a pulse voltage signal (referred to hereinafter as an UP signal) applied to the input terminal N4 to flow out of the charge pump circuit CP at the output terminal N1. When the UP signal and the DOWN signal are inputted at the same time, the current is caused to flow into or out of the charge pump circuit CP at the output terminal N1 depending on the difference between the pulse width of the UP signal and the pulse width of the DOWN signal. The output current is zero at the output terminal N1 if the pulse width of the UP signal equals that of the DOWN signal.

The charge pump circuit CP comprises the current mirror circuit CM1. The N-channel MOS transistor T4 and the bias voltage generating circuit VB1 both shown in FIG. 1 are illustrated in FIG. 5 together as a constant current source IS3. A power supply potential Vdd is applied to the drain of the N-channel MOS transistor T3. The N-channel MOS transistors T1 and T2 are designed to be of the same size.

The drain of the N-channel MOS transistor T1 is connected to the drain of a P-channel MOS transistor P1. The charge pump circuit CP further comprises an operational amplifier A1 for providing an output to the gate of the P-channel MOS transistor P1, and a bias voltage generating circuit VB2 for applying a constant potential to a positive input terminal of the operational amplifier A1. The source of the P-channel MOS transistor P1 is connected to a negative input terminal of the operational amplifier A1.

A constant current source IS1 is connected between the source of the P-channel MOS transistor P1 and a power supply providing the potential Vdd. A capacitor C1 and a resistor R1 which are connected in series are connected in parallel with the constant current source IS1. The source and drain of a P-channel MOS transistor P3 are connected in parallel with the capacitor C1, and the gate of the P-channel MOS transistor P3 is connected to the input terminal N3. The above described circuitry connected to the drain of the transistor T1 is referred to hereinafter as a DOWN-side circuit.

Circuitry which is similar in construction and characteristic to the DOWN-side circuit is also connected to the drain of the N-channel MOS transistor T2 and is referred to hereinafter as an UP-side circuit. Specifically, the UP-side circuit comprises an operational amplifier A2, P-channel MOS transistors P2 and P4, a constant current source IS2, a capacitor C2 and a resistor R2 in corresponding relation to the operational amplifier A1, the P-channel MOS transistors P1 and P3, the constant current source IS1, the capacitor C1 and the resistor R1 of the DOWN-side circuit.

The operation of the charge pump circuit CP will be described with attention focused on the UP-side circuit. When the UP signal is inputted to the input terminal N4 to turn on the P-channel MOS transistor P4 in a pulsing manner, a current averaged by a filter comprised of the capacitor C2 and the resistor R2 and having a frequency band close to that of a direct current flows through the resistor R2.

The operational amplifier A2 functions to make the source potential of the P-channel MOS transistor P2 equal to the constant potential outputted from the bias voltage generating circuit VB2. Specifically, when an excessive amount of current flows through the P-channel MOS transistor P2 to result in the decrease in the source potential thereof, the operational amplifier A2 increases the output potential, and the P-channel MOS transistor P2 limits the current to prevent the source potential thereof from decreasing. The operation is reversed when the source potential of the P-channel MOS transistor P2 is increased. As a result, the operational amplifier A2 operates so that the source potential of the P-channel MOS transistor P2 becomes equal to the output signal from the bias voltage generating circuit VB2 by means of negative feedback.

The source potential of the P-channel MOS transistor P2 is thus always held constant, whereby the current depending on the pulse width of the UP signal flows through the resistor R2. The reason therefor is that if the source potential of the P-channel MOS transistor P2 is directly connected to the output terminal N1 and is varied depending on the operating state of an external circuit connected to the output terminal N1, the current flowing through the resistor R2 is changed and is not held constant, failing to attain a complete direct current. Although the potential at one end of the resistor R2 which is connected to the capacitor C2 having a large capacitance is not significantly varied when the P-channel MOS transistor P4 is operated, the potential at the opposite end of the resistor R2 from the capacitor C2 is directly influenced by the circuit operating state. Therefore, it is desirable that there is provided a circuit for holding a constant voltage which is comprised of the P-channel MOS transistor P2 and the operational amplifier A2.

The constant current source IS2 is provided for purposes of ensuring a minimum current since a negative feedback system including the operational amplifier A2 is not stable if the current flowing through the P-channel MOS transistor P2 is in a very small amount.

The components of the DOWN-side circuit exhibit similar functions. Specifically, when the DOWN signal is inputted to the input terminal N3 to turn on the P-channel MOS transistor P3, a current averaged by a filter comprised of the capacitor C1 and the resistor R1 and having a frequency band close to that of a direct current flows through the resistor R1. This current has a value depending on the pulse width of the DOWN signal. Since the DOWN-side circuit includes the constant current source IS1 which is similar in characteristic to the constant current source IS2, the current flowing out of the constant current source IS1 and the current flowing out of the constant current source IS2 exert no effects upon the output current from the current mirror circuit CM1.

The operation of the charge pump circuit CP is discussed below. It is now assumed, for example, that the pulse width of the UP signal is greater than that of the DOWN signal. In this case, the value of the current flowing through the P-channel MOS transistor P2 in the UP-side circuit is greater than that of the current flowing through the P-channel MOS transistor P1 in the DOWN-side circuit, as compared with those in the case where the UP signal and DOWN signal which are equal in pulse width are inputted. However, the presence of the current mirror circuit CM1 requires the equal values of the current flowing through the N-channel MOS transistor T1 and the current flowing through the N-channel MOS transistor T2. To meet this requirement, the difference between the current flowing through the P-channel MOS transistor P2 and the current flowing through the P-channel MOS transistor P1 flows out of the charge pump circuit CP at the output terminal N1.

It is assumed, on the other hand, that the pulse width of the DOWN signal is greater than that of the UP signal. In this case, the value of the current flowing through the P-channel MOS transistor P1 in the DOWN-side circuit is greater than that of the current flowing through the P-channel MOS transistor P2 in the UP-side circuit, as compared with those in the case where the UP signal and DOWN signal which are equal in pulse width are inputted. However, the presence of the current mirror circuit CM1 requires the equal values of the current flowing through the N-channel MOS transistor T1 and the current flowing through the N-channel MOS transistor T2. To meet this requirement, the difference between the current flowing through the P-channel MOS transistor P2 and the current flowing through the P-channel MOS transistor P1 flows into the charge pump circuit CP at the output terminal N1.

In the charge pump circuit CP as above described, it is desirable that the output current is zero at the output terminal N1 when the pulse width of the UP signal equals that of the DOWN signal. It is accordingly desirable that the current flowing through the N-channel MOS transistor T1 and the current flowing through the N-channel MOS transistor T2 have exactly equal values independently of the potential at the output terminal N1. Although the use of the conventional current mirror circuit CM2 results in the likelihood that the current flowing through the N-channel MOS transistor T1 and the current flowing through the N-channel MOS transistor T2 are not exactly equal to each other because of the variations in the potential at the output terminal N1, the use of the current mirror circuit CM1 illustrated in the first preferred embodiment of the present invention renders the operation of the charge pump circuit CP more accurate.

While the invention has been described in detail, the foregoing description is in all aspects illustrative and not restrictive. It is understood that numerous other modifications and variations can be devised without departing from the scope of the invention.

I claim:

1. A current mirror circuit comprising:

an output terminal;

a first transistor having a first current electrode, a second current electrode, and a control electrode connected to said first current electrode, there being a flow of a reference current between said first and second current electrodes;

a second transistor having a first current electrode connected to said output terminal, a second current electrode connected to said second current electrode of said first transistor, and a control electrode connected to said control electrode of said first transistor;

a third transistor having a first current electrode, a second current electrode connected to said second current electrode of said first transistor, and a control electrode connected to said output terminal, there being a flow of a predetermined current between said first and second current electrodes of said third transistor; and a first constant current source connected to said second current electrode of said first transistor.

2. The current mirror circuit according to claim 1, wherein said first constant current source comprises:

a fourth transistor having a first current electrode connected to said second current electrode of said first transistor, a second current electrode grounded, and a control electrode; and a constant voltage source for outputting a constant voltage to said control electrode of said fourth transistor.

3. A charge pump circuit comprising:

an output terminal;

a first transistor having a first current electrode, a second current electrode, and a control electrode connected to said first current electrode, there being a flow of a reference current between said first and second current electrodes;

a second transistor having a first current electrode connected to said output terminal, a second current electrode connected to said second current electrode of said first transistor, and a control electrode connected to said control electrode of said first transistor;

a third transistor having a first current electrode, a second current electrode connected to said second current electrode of said first transistor, and a control electrode connected to said output terminal, there being a flow of a predetermined current between said first and second current electrodes of said third transistor;

a first constant current source connected to said second current electrode of said first transistor;

a fourth transistor having a first current electrode connected to said output terminal, a second current electrode, and a control electrode;

a first operational amplifier having a first input connected to said second current electrode of said fourth transistor, a second input receiving a reference potential, and an output connected to said control electrode of said fourth transistor; and a first filter receiving a first pulse signal for smoothing said first pulse signal to apply the smoothed first pulse signal to said second current electrode of said fourth transistor.

4. The charge pump circuit according to claim 3, further comprising a second constant current source connected to said second current electrode of said fourth transistor.

5. The charge pump circuit according to claim 3, wherein said first filter comprises:

a capacitor having a first end receiving a power supply potential, and a second end; and a resistor having a first end connected to said second current electrode of said fourth transistor, and a second end connected to said second end of said capacitor.

6. The charge pump circuit according to claim 5, further comprising a fifth transistor having a control electrode receiving said first pulse signal, a first current electrode connected to said first end of said capacitor, and a second current electrode connected to said second end of said capacitor.

7. The charge pump circuit according to claim 3, further comprising:

a fifth transistor having a first current electrode connected to said first current electrode of said first transistor, a second current electrode, and a control electrode;

a second operational amplifier having a first input connected to said second current electrode of said fifth transistor, a second input receiving said reference potential, and an output connected to said control electrode of said fifth transistor; and a second filter receiving a second pulse signal for smoothing said second pulse signal to apply the smoothed second pulse signal to said second current electrode of said fifth transistor.

8. The charge pump circuit according to claim 7, further comprising a second constant current source connected to said second current electrode of said fifth transistor.

9. The charge pump circuit according to claim 7, wherein said second filter comprises:

a capacitor having a first end receiving a power supply potential, and a second end; and a resistor having a first end connected to said second current electrode of said fifth transistor, and a second end connected to said second end of said capacitor.

10. The charge pump circuit according to claim 9, further comprising a sixth transistor having a control electrode receiving said second pulse signal, a first current electrode connected to said first end of said capacitor, and a second current electrode connected to said second end of said capacitor.

11. The current mirror circuit according to claim 1, wherein said first constant current source includes:

a fourth transistor having a drain electrode connected to said second current electrode of said first transistor, and a source electrode receives a fixed potential, and wherein the respective first current electrodes of said first to third transistors are drain electrodes and the respective second current electrodes of said first to third transistors are source electrodes.

* * * * *